United States Patent [19]

Iizuka et al.

[11] Patent Number: 4,808,022

[45] Date of Patent: Feb. 28, 1989

[54] CONTAINER TYPE TOILET IMPLEMENT

[75] Inventors: Shigeo Iizuka; Tadao Saito, both of Tokyo, Japan

[73] Assignee: Yoshino Kogyosho Co., Ltd., Tokyo, Japan

[21] Appl. No.: 147,629

[22] Filed: Jan. 27, 1988

Related U.S. Application Data

[63] Continuation of Ser. No. 854,768, Apr. 23, 1986.

[30] Foreign Application Priority Data

Jul. 11, 1985 [JP] Japan ..... 60-106417[U]
Nov. 15, 1985 [JP] Japan ..... 60-176232[U]

[51] Int. Cl.[4] ..... A46B 11/02; B05C 1/06
[52] U.S. Cl. ..... 401/176; 401/171
[58] Field of Search ..... 401/176, 177, 179, 182, 401/171, 146, 149, 150, 151, 194; 132/85, 88

[56] References Cited

U.S. PATENT DOCUMENTS

| | | | |
|---|---|---|---|
| 1,207,121 | 12/1916 | Zeidler | 401/150 |
| 2,293,211 | 8/1942 | Mureau | 401/176 |
| 3,167,806 | 2/1965 | Hogan | 132/85 X |
| 3,181,539 | 5/1965 | Aston | 132/85 X |
| 3,351,074 | 11/1967 | Aston . | |
| 3,359,992 | 12/1967 | Cishek et al. | 401/171 X |
| 3,468,612 | 9/1969 | Aston | 132/88.7 X |
| 4,309,119 | 1/1982 | Wittersheim | 401/176 X |

FOREIGN PATENT DOCUMENTS

| | | | |
|---|---|---|---|
| 165657 | 10/1955 | Australia . | |
| 62059/65 | 2/1967 | Australia . | |
| 440628 | 9/1973 | Australia . | |
| 0123518 | 10/1984 | European Pat. Off. | 401/146 |
| 2630569 | 1/1978 | Fed. Rep. of Germany . | |
| 2551636 | 3/1985 | France . | |
| 1562817 | 3/1980 | United Kingdom . | |
| 2150424 | 7/1985 | United Kingdom | 401/171 |

*Primary Examiner*—Dennis L. Taylor
*Attorney, Agent, or Firm*—Parkhurst, Oliff & Berridge

[57] ABSTRACT

A container type toilet implement includes a container body, and a bottom cover provided liquid tightly and elevationally movable at the lower portion of the container. A cylinder is erected upward from a neck of the container. A suction valve is mounted in the lower portion of the cylinder. A piston is engaged at the lower portion thereof with the upper inside of the cylinder and disposed slidably telescopically in the cylinder. A spring member is disposed between the cylinder and the piston for urging the cylinder downwardly. An exhaust valve member has two elastic plates extending downwardly at a predetermined interval from an upper end cylindrical portion formed in the piston, the elastic plates having opposed bent parts in a ring shape substantially at the intermediate area thereof. A rod valve is disposed below the exhaust valve member, and an exhaust valve body is formed at the lower portion of the elastic plate of the exhaust valve member. A valve seat is formed at the central inner surface of the piston, and a sealing mechanism is provided for sealing the interior of the cylinder. A brush tip is disposed at the top of the exhaust valve member. The container type toilet implement prevents the liquid lotion in the container from leaking.

9 Claims, 2 Drawing Sheets

CONTAINER TYPE TOILET IMPLEMENT

This is a continuation of application Ser. No. 854,768, filed Apr. 23, 1986.

BACKGOUND OF THE INVENTION

This invention relates to a container type toilet implement for containing liquid toilet article such as, for example, an eyebrow pencil or a liquid lipstick or rouge in a container to supply the article to the tip of a brush provided at the end of the container by operating a cylinder and piston mechanism provided in the container.

A conventional toilet implement using liquid toilet lotion is constructed to clamp a cap integrally drooped from a brush tip retaining shaft with a container for containing the liquid toilet lotion and to impregnate the lotion in the container with the brush tip formed at the end of the tip retaining shaft. Thus, when making up a face with the implement, a cap is removed from the container, the cap is used as a grasping member, and the lotion impregnated at the brush tip is coated on the face.

In the conventional toilet implement described above, when the liquid lotion is impregnated with the brush tip, it is necessary to insert the tip into the container at every makeup time thereby causing the application of makeup to be complicated. Further, when the cap is removed at using time container is feasibly overturned to leak the lotion in the container. Then, since the quantity of the liquid toilet lotion impregnated with the brush tip is not constant, a liquid droplet tends to fall from the brush tip.

SUMMARY OF THE INVENTION

Accordingly, it is an object of this invention to provide a container type toilet implement which can eliminate the abovementioned disadvantages of the conventional toilet implement and can supply a constant quantity of toilet lotion to the brush tip thereof to obviate the droplet from the brush tip and prevent the liquid lotion in the container from leaking.

According to this invention, there is provided a container type toilet implement which comprises a container body formed liquidtightly with an elevationally movable bottom cover at the bottom, a cylinder and piston mechanism projected upwardly from the neck of the container, and a brush tip mounted at the tip retaining unit, thereby eliminating the possibility of leaking the lotion and the overturning of the container.

The foregoing object and other objects as well as the characteristic features of the invention will become more fully apparent and more readily understandable by the following description and the appended claims when read in conjunction with the accompanying drawings.

DESCRIPTION OF THE PREFERRED EMBODIMENTS

An embodiment of this invention will be described in detail with reference to the accompanying drawings.

Figure 1:
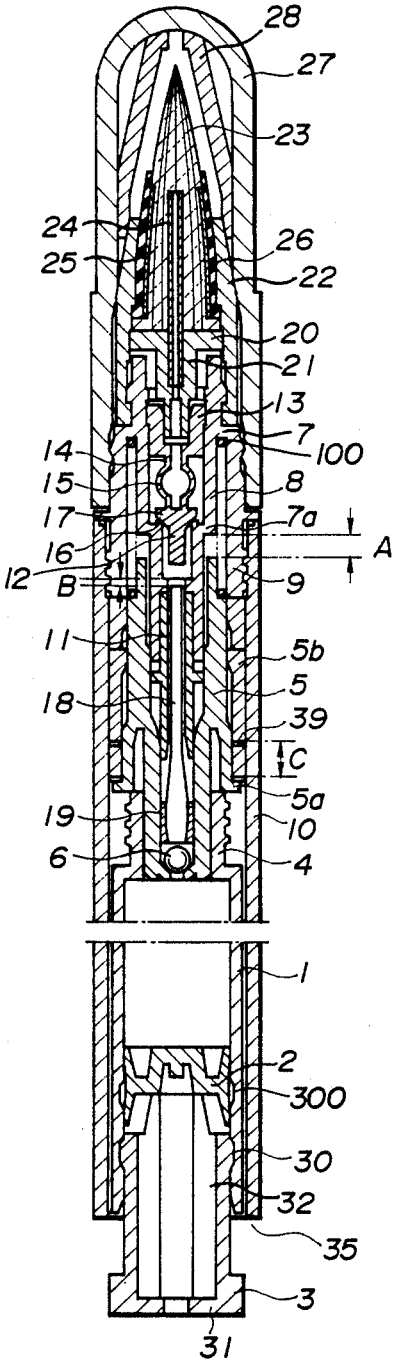
FIG. 1 is a longitudinal fragmentary sectional view of a first embodiment of a container type toilet implement according to this invention.

FIG. 1 shows a first embodiment of a container type toilet implement according to this invention.

The container type toilet implement of this invention comprises a container 1 for containing liquid toilet article, and an elevationally movable bottom cover 2 is liquidtightly provided at the bottom of the container 1. A button 3 for pressing upwardly the container 1 is engaged with the lower end of the container.

A cylinder 5 is projected upwardly from the neck 4 of the container 1, and engaged within the neck 4 so as to elevationally move upwardly and downwardly integrally with the container 1. A suction valve 6 is engaged in the lower portion of the cylinder 5 engaged within the neck 4, and a piston 7 formed substantially in an inverted U shape is telescoped within the upper portion of the cylinder 5.

The piston 7 has a double cylindrical structure of inverted U shaped section as described above, and the lower outer periphery of an outer cylinder 9 is engaged via threads with the upper portion of an external cylinder 10 located on the outer periphery of the container 1. A step *7a* for controlling the upward movement of the cylinder 5 is formed at the inner cylinder 8 of the piston 7. Further, a sealing member 11 which is hermetically supported at the lower end to the inner periphery in the vicinity of the center of the cylinder 5 and does not prevent the cylinder from sliding is secured fixedly to the lower portion of the inner cylinder 8 of the piston 7. Thus, it can prevent the liquid toilet article in the container from leaking externally of the cylinder when the suction valve 6 is opened. An exhaust valve member 12 is disposed at the upper inside of the inner cylinder 8 of the piston 7, and is fixedly secured to the inner surface of the piston 7 by the top cylindrical portion 13. Two elastic plates 14 are drooped at a predetermined interval from the lower surface of the cylindrical portion 13, and a bent portion 15 is formed at the intermediate area of the plates 14 in an opposed manner in a ring shape. Further, an outward flange-shaped valve body 17 contacted under pressure with a projecting valve seat 16 formed on the central inner surface of the inner cylinder 8 of the piston 7 is formed on the lower part of the bent portion 15. A valve rod 18 is disposed at a predetermined interval B below the valve member 12, and is secured fixedly at the lower part thereof through a liquid passage 19 onto the lower inner periphery of the cylinder 5. A cylindrical member 21 having a flange 20 projected at the upper end outwardly is engaged fixedly within the cylindrical portion 13 of the valve member 12. A brush tip retaining shaft 22 of converged shape at the end is detachably engaged with the upper end of the piston 7.

A brush tip 23 is mounted at the shaft 22, and is formed at the lower end in a flange solidified by an adhesive or thermal fusion-bonding to be engaged on the flange 20 of the cylindrical member 21. A hollow cylindrical core 24 for guiding toilet article or lotion to the brush tip is disposed in the vicinity of the inner center of the tip 23, and the lower end of the core 24 is engaged within the cylindrical member 21 to communicate with the valve member 12.

A metallic cylinder 25 is coated on the lower outer half periphery of the tip 23, and a rubber cylinder 26 is engaged between the cylinder 25 and the shaft 22. The cylindrical core 24, the metallic cylinder 25 and the rubber cylinder 26 are disposed at the ends so that the core 24 is disposed at the tip side from the metallic cylinder 25 and the rubber cylinder 26 is disposed further at the end of the tip 24 from the core 24.

Figure 2A:
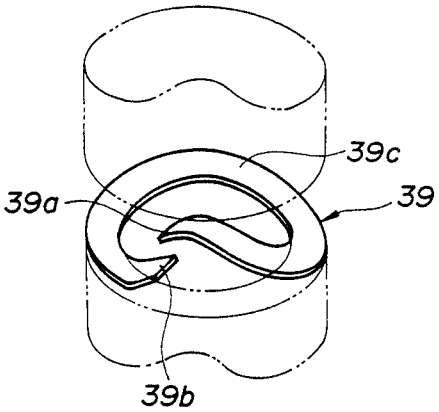
FIGS. 2(*a*) and 2(*b*) are perspective views of a sound producing mechanism employed in the toilet implement.
Figure 2B:
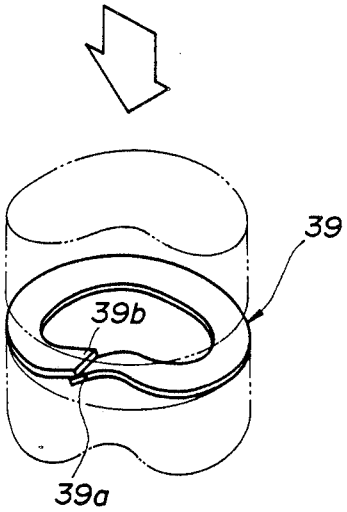

A cap 27 is engaged with the outside of the tip retaining shaft 22, and is constructed to be engaged with the outer periphery of the outer cylinder 9 of the piston 7. Further, an inner cap 28 is engaged fixedly within the cap 27 so that the inner peripheral end is hermetically engaged with the outer periphery of the end of the tip retaining shaft 22, thereby preventing the brush tip from drying. A sound producing mechanism 39 announces the fact that the pushbutton 3 lifts the cylinder 5 and the container 1 at a predetermined distance, and is disposed between the flange 5*a* projected outwardly from the cylinder 5 and the supporting member 5*b* disposed at a predetermined interval C above the flange 5*a* outside the cylinder 5. The mechanism 39 is formed, as shown in FIGS. 2(*a*) and 2(*b*), with a wavy ring-shaped leaf spring 39*c* partly cut so that one cut end 39*a* is slightly superposed on the other cut end 39*b* of the leaf spring 39*c*. Thus, when the cylinder 5 moves upward, the leaf spring 39*c* is compressed between the flange 5*a* and the member 5*b*, the upper end 39*a* thereafter overrides the lower end 39*b* by the elasticity, whereupon a clicking sound is produced. The interval C between the flange 5*a* and the member 5*b* is formed to be substantially equal to the interval A between the end of the cylinder 5 and the step 7*a* of the piston 7. In other words, when the end of the cylinder 5 makes contact with the step of the piston 7, the sound producing mechanism 39 produces a sound of click.

As described above, when the liquid toilet lotion is supplied by the cylinder and piston mechanism to the brush tip, it is necessary that the liquid lotion should be already filled to the end of the hollow cylindrical core of the brush tip at the first using time. However, when the toilet implement of the construction described above is associated in fact, it is difficult to supply the liquid lotion to the end of the hollow cylindrical core, and the lotion is filled only to the container 1. Thus, the liquid lotion is not filled to the upper portion of the cylinder. In this state, even if the cylinder and piston mechanism is operated, the lotion cannot be supplied to the brush tip.

Therefore, in this embodiment according to this invention, the following feature is provided to eliminate this inconvenience.

The pushbutton 3 provided at the lower portion of the container 1 is engaged at the end with a first engaging groove 30 formed near the lower end of the container 1, and a pressing head 31 is projected from the outer cylinder. Further, a shaft 32 contacting with the lower end of the bottom cover 2 is formed in the vicinity of the center of the pushbutton 3, and when the pushbutton 3 is depressed, the cover 2 is moved upward. In addition, a second engaging groove 300 is formed above the first engaging groove 30 of the container 1 to engage the pushbutton 3. The cover 2 is formed at the peripheral edge in an arcuate-shaped sectional elastic peripheral wall, which is pressed to the inner surface of the container 1 to be mounted liquidtightly and elevationally movably. A notch 35 is formed at one side lower end of the cylinder 9, and the pushbutton 3 is constructed to be depressed by means of the notch 35.

In the construction described above, when the pushbutton 3 is depressed before using in fact the toilet implement of this invention, the container 1, the cylinder 5 and the valve rod 18 move integrally. However, from the relationship of the interval B being smaller than the interval A, the valve rod 18 presses the valve member 12 to open the valve body 17. Further, the cylinder 5 contacts at the end with the step 7*a* of the piston 7 to stop upward movement of the cylinder 5, the valve rod 18 and the container 1. When the pushbutton 3 is further depressed until engaging with the second engaging groove, the bottom cover 2 is lifted upwardly by the moving distance of the bottom cover 7 by the movement of the pushbutton 3 to the second engaging groove, and the suction valve 8 is opened by the pressure in the container, and the toilet lotion is filled from the container through the valve member to the end of the hollow cylindrical core.

The operation of the container type toilet implement having the construction described above will now be described. The toilet lotion is initially filled to the top in the cylinder 5 by the operation of the pushbutton 3. Then, to make up a face the pushbutton 3 is pressed to lift the container 1, the cylinder 5 and the valve rod 18 (all of which are interconnected) against a return spring 100. This operation causes the volume of the cylinder 5 to decrease in response to movement of the cylinder 5 and valve rod 18, thus pressurizing the lotion in the cylinder. Since the upper end of the valve rod 18 lifts the bottom end of the exhaust valve member 12, the lower portions of the elastic plates 14 of the exhaust valve member 12 are lifted to open the valve body 17. Then, the lotion is fed through the elastic plates 14 to the hollow cylindrical core 24 for guiding the lotion, and then supplied to the brush tip 23. When the pushbutton 3 is released, the return spring moves the cylinder 5 and valve rod 18 downwardly thus increasing the volume of the cylinder 5. The elastic plates 14 and bent parts 15 move the valve body downwardly. The interior of the cylinder is evacuated in negative pressure, the suction valve 6 is thus opened to suck the lotion into the cylinder 5 in the container body 1, and the bottom cover 2 is moved upwardly by atmospheric response to the opening of the suction valve 6.

Figure 3:
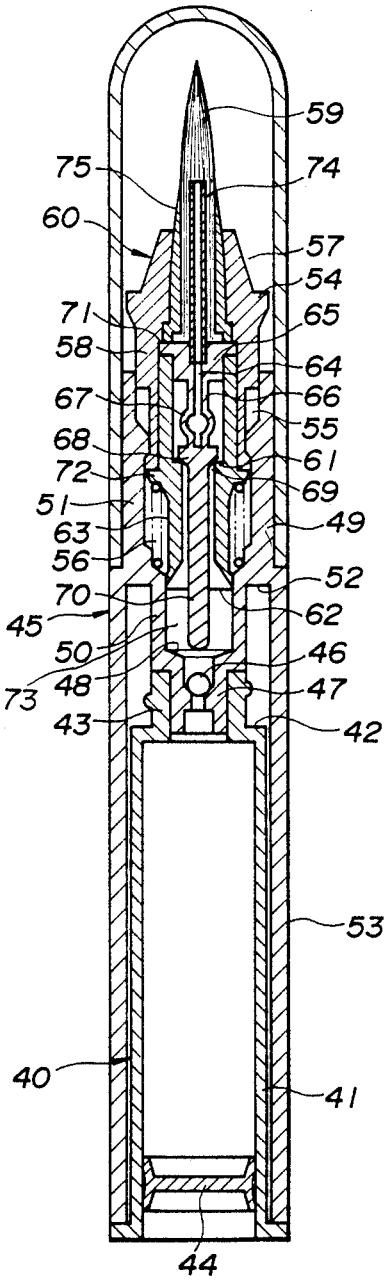
FIG. 3 is a longitudinal sectional view of a second embodiment of the invention.

FIG. 3 shows a second embodiment of the container type toilet implement according to this invention. A container 40 has a body 41 having a bottom opening, and a neck 43 is erected through a shoulder 42. A bottom cover 44 is engaged liquidtightly and elevationally movably with the bottom opening of the body, and toilet article is filled in the body 41 above the cover 44.

Reference numeral 45 designates a holding column with a cylinder to erect a supporting cylindrical portion 49 through an outward flange 48 placed on the top of the neck from the top of a small cylindrical portion 47 with a suction valve 46 engaged within the neck. The lower part of the supporting cylindrical portion is formed in a cylindrical portion 50 and the upper part is formed in an engaging cylindrical portion 51 and the cylindrical portion 51 is formed larger in diameter than the cylindrical portion 50. A coating cylindrical portion 53 is drooped through an outward flange 52 from the top of the engaging cylindrical portion, and the cylindrical portion is engaged with the outer periphery of the body of the container.

A rockable cylindrical portion 55 extends from the top wall 54 is urged upwardly by a spring 56 and engaged with an operating member 57 to be elevationally movably upwardly and downwardly in the supporting cylindrical portion 49.

The operating member 57 is drooped at the peripheral wall 58 from the peripheral edge of the top wall 54. The operating member 57 is engaged at the center of the top wall with an upper member 60 secured to the base end of the brush tip 59, at the upper cylindrical portion within the peripheral wall 58, at the cylindrical inner surface with an upward valve seat 61, and at the lower cylindrical end with a cylindrical member 63 formed at the cylindrical piston 62. Two elastic plates 66 are drooped at a predetermined interval from the lower surface of a plug 65 with a through hole 64 engaged with the top of the cylindrical member 53 in such a manner that a bent portion 67 formed at the intermediate of the elastic plate is opposed in a ring shape. An exhaust valve body 68 is attached to the lower end of the elastic plate to press under pressure the valve seat 61 to form an exhuast valve 89, and formed with an exhaust valve member 71 drooped with a valve rod 70 from the valve body.

A projecting strip 72 is formed on the outer intermediate surface of the cylindrical member 63. A coil spring 56 is movably engaged with the outer surface of the cylindrical portion below the strip, and engaged at the lower end with the upward step of the inner lower end of the cylindrical portion 51 and at the upper end with the lower surface of the strip 72. Thus, when the member 60 is depressed, the piston 62 moves down in the cylinder to pressurize the interior of a pressure chamber 73 formed in the space between the suction valve 46 and the exhuaust valve 68, thereby opening the exhaust valve 68 against the elasticity of the elastic plate 66 and supplying the toilet lotion to the brush tip through the hole 64 and a pipe 74 for guiding the lotion to be disposed near the center of the brush tip. The valve rod 70 prevents a ball valve (forming the suction valve 46) from moving out of the valve chamber. The outer periphery of the brush tip is coated with a brush tip retaining member 75 except the tip in the same manner as the previous embodiment.

Figure 4:
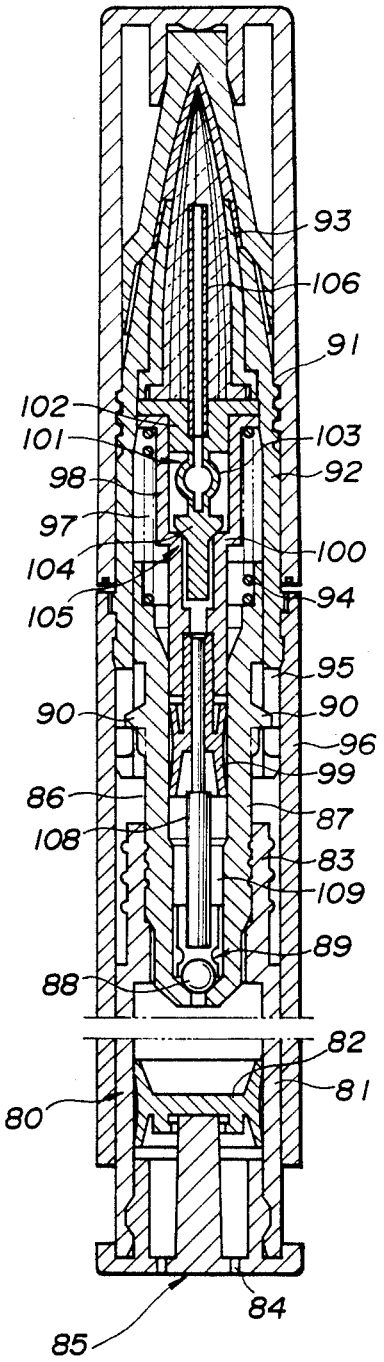
FIG. 4 is a longitudinal sectional view of a third embodiment of the invention.

FIG. 4 shows a third embodiment of the container type toilet implement according to this invention. A container 80 has a linear cylindrical body 81, and a bottom cover 82 elevationally movable in liquidtight contact at the outer periphery with the inner wall surface of the body. A neck 83 is erected through a shoulder from the body 81, and a blocking plug 85 with a through hole 84 is engaged with the lower end of the body.

A first cylindrical portion 87 of a cylinder 80 engaged at the lower end within the neck is projected upwardly. A ball valve 88 is sealed in the lower end as a small-diameter portion to the lower end of the first cylindrical portion 87, and a suction valve 89 is formed of the samll-diameter portion and the ball valve. Connectors 90 are projected from both right and left sides of the intermediate portion of the cylinder.

A brush tip shaft 91 is erected upward at the brush tip 93 from the top of a second cylindrical portion 92, and the top of the cylinder is engaged to be elevationally movable by a spring 94 in the cylindrical portion 92. Through holes 95 engaged elevationally movably are provided longitudinally with the connectors 90 in the cylindrical portion 92. An outer cylinder 96 engaged slidably with the outer surface of the body of the container is engaged at the upper end with the lower outer surface of the second cylindrical portion 92.

A member 97 with a piston is secured at the upper end to the upper inner surface of the second cylindrical portion of the brush tip shaft to droop a third cylindrical portion 98. A cylindrical piston 99 is attached to the lower end of the third cylindrical portion, and an inward flange valve seat 100 is formed on the inner surface of the third cylindrical portion.

A member 101 with a valve body is secured at the upper cylindrical end 102 to the top inner surface of the second cylindrical portion 92 or the third cylindrical portion 98 to droop a pair of right and left sides of arcuate elastic plates 103. A valve body 104 attached to the lower portion of the elastic plate is contacted under pressure with the valve seat 100 to form an exhaust valve 105. A pipe 106 is drooped at the lower end for guiding toilet article or lotion in the upper cylindrical end 102, and the pipe 106 is extended at the end to the intermediate area of the upper and lower ends of the axial core of the brush tip 93.

A rod member 108 is internally mounted in the cylinder 86 to increase the compression ratio in a pressurizing chamber formed between the valves 89 and 105. The member 108 is projected at a spacer 109 radially from the lower outer surface of the rod portion so that the end of the spacer is contacted under pressure with the lower inner wall of the cylinder to be secured to the cylinder, and the rod portion is disposed at the lower end above the ball valve 88 to prevent the ball valve from removing out of the valve chamber.

Further, the upper half of the rod is inserted elevationally movably at the upper portion as a small-outer diameter portion into the member with a piston. The rod member is operated to lift the valve body at the upper end of the rod portion only when the container is lifted to the upper limit with respect to the brush tip shaft to open the exhaust valve by the lifting.

According to this invention as described above, the container type toilet implement comprises the cylinder and piston mechanism, thereby supplying liquid toilet article or lotion in the container to the brush tip by the operation of the mechanism. Thus, the toilet implement does not drop the toilet lotion to the excessively impregnated content as in the conventional toilet implement which dips the brush tip directly in the toilet lotion. Further, since the toilet implement of this invention comprises the exhaust valve, it does not leak the lotion even if the implement is tilted or overturned. Moreover, since the toilet implement of this invention includes the bottom cover elevationally movable in liquidtight engagement with the lower end of the container, it can prevent the toilet lotion in the container from having a negative pressure due to the rise of the bottom cover, thereby eliminating the outer air flowing hole for the container of the conventional toilet implement, and thus preventing the lotion from leaking from the flowing hole or from evaporating.

What is claimed is:

1. A container type toilet implement comprising:

a container body having upper and lower portions, a neck of the container body being located in the upper portion of the container body;

an external cylinder surrounding an outer periphery of said container body;

a bottom cover provided liquid tightly and elevationally movable at the lower portion of said container body;

an upwardly extending cylinder erected at the neck of said container body;

a suction valve mounted in a lower portion of said cylinder;

a piston engaged at a lower portion thereof with an upper inner surface of said cylinder and disposed slidably and telescopically in said cylinder, said piston having a top portion opposite said lower portion;

a spring member disposed between said cylinder and said piston for urging said cylinder downwardly;

an exhaust valve member having two elastic plates extending downwardly at a predetermined interval from an upper end cylindrical portion formed in said piston, said elastic plates having opposed bent parts in a ring shape substantially at an intermediate area thereof;

a rod valve disposed in said cylinder below said exhaust valve member and spaced therefrom, said rod valve extending at a lower end thereof to the lower portion of said cylinder;

an exhaust valve body formed at a lower portion of the elastic plates of said exhaust valve member and a valve seat formed at a central inner surface of said piston;

a sealing mechanism for sealing the interior of said cylinder; and a brush tip disposed above said exhaust valve member and supplied with a toilet article through said exhaust valve member, wherein said piston is secured directly or indirectly to the external cylinder on the outer periphery of said container body, and said exhaust valve member is secured to the top portion of said piston.

2. The container type toilet implement according to claim 1, wherein a pushbutton for pressing said container body and said cylinder upward is engaged with the lower portion of said container body.

3. The container type toilet implement according to claim 1, wherein a step for suppressing the rise of said cylinder is formed in said piston.

4. The container type toilet implement according to claim 1, wherein the lower end of said rod valve is secured to the lower portion of said cylinder, a liquid passage being defined between said rod valve and said cylinder.

5. The container type toilet implement according to claim 3, wherein an interval (B) between an upper end of said rod valve and a lower end of said exhaust valve member is narrower than the interval (A) between an upper end of said cylinder and the step of said piston.

6. The container type toilet implement according to claim 2, wherein first and second grooves for engaging said pushbutton are formed at a predetermined interval on a lower inner peripheral wall of said container body, said pushbutton being initially engaged with the first groove and an end of said pushbutton contacting a lower surface of said bottom cover, said bottom cover being lifted upward for the interval between said first and second grooves by said pushbutton when said pushbutton is moved and engaged from the first groove to the second groove, thereby pressurizing the interior of said container, then evacuating air in the cylinder and filling the toilet article in the cylinder.

7. The container type toilet implement according to claim 1, wherein a cylindrical member having a hole communicating with the brush tip is disposed above said exhaust valve member.

8. The container type toilet implement according to claim 1, wherein a sound producing mechanism is mounted on a flange projected outwardly of said cylinder, said mechanism including a disk spring member formed in a wavy ring shape and cut to define supporting members disposed at a predetermined interval above the flange in such a manner that one end thereof and the other end thereof are slightly superposed, compression of said leaf spring causing one end to override the other end by its elasticity.

9. A container type toilet implement comprising:

a container body having upper and lower portions, a neck of said container body being located in the upper portion of the container body;

a bottom cover provided liquidtightly and elevationally movable at the lower portion of said container body;

a cylinder erected at the neck of said container body and extending upwardly therefrom;

a suction valve mounted in a lower portion of said cylinder;

a piston having a substantially inverted U-shaped sectional double cylinder defining inside and outside cylindrical portions, said piston being engaged at a lower portion thereof with an upper inner surface of said cylinder and disposed slidably telescopically in said cylinder;

said piston being formed at a substantially intermediate position on an inside cylindrical portion thereof with a step for controlling upward movement of said cylinder and with a valve seat on an outer intermediate position of said inside cylindrical portion;

a spring member disposed between said cylinder and said piston for urging said cylinder downwardly;

an outer cylinder surrounding an outer periphery of said container body and engaged with the outer cylindrical portion of said piston at an upper end thereof;

an exhaust valve member having two elastic plates extending downwardly at a predetermined interval from an upper end cylindrical portion formed in said piston, said elastic plates having opposed bent parts in a ring shape substantially at an intermediate area thereof;

a rod valve disposed below said exhaust valve member at a predetermined interval and extending at a lower end thereof toward the lower portion of said cylinder;

a liquid passage formed between said rod valve and said cylinder;

an exhaust valve body formed at a lower portion of the elastic plates of said exhaust valve member and a valve seat formed at a central inner surface of said piston;

a sealing mechanism for sealing the interior of said cylinder;

a cylindrical member disposed above said exhaust valve member and having a passage communicating with said exhaust valve member;

a brush tip disposed at an upper end of said cylindrical member;

a hollow cylindrical core engaged within said brush tip to communicate with the cylindrical member;

a metallic tube surrounding an outer periphery of said brush tip;

a brush tip retaining member surrounding an outside of said tube on the outer periphery of said brush tip; and a brush tip retaining shaft having an upper end engaged with said brush tip retaining member and a lower end with the top of said piston.

* * * * *